US007517833B2

(12) United States Patent
Fukui et al.

(10) Patent No.: US 7,517,833 B2
(45) Date of Patent: Apr. 14, 2009

(54) THERMAL TRANSFER SHEET AND PROTECTIVE LAYER TRANSFER SHEET

(75) Inventors: Daisuke Fukui, Tokyo (JP); Kenichi Hirota, Tokyo (JP); Sakie Iwaoka, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 11/577,810

(22) PCT Filed: Oct. 25, 2005

(86) PCT No.: PCT/JP2005/019608

§ 371 (c)(1),
(2), (4) Date: Aug. 9, 2007

(87) PCT Pub. No.: WO2006/046566

PCT Pub. Date: May 4, 2006

(65) Prior Publication Data

US 2008/0152847 A1 Jun. 26, 2008

(30) Foreign Application Priority Data

Oct. 25, 2004 (JP) ..... 2004-309278
Mar. 31, 2005 (JP) ..... 2005-105349
Mar. 31, 2005 (JP) ..... 2005-105464

(51) Int. Cl.
*B41M 5/035* (2006.01)
*B41M 5/50* (2006.01)

(52) U.S. Cl. ..... 503/227; 428/32.81; 428/195.1

(58) Field of Classification Search ..... None
See application file for complete search history.

(56) References Cited

FOREIGN PATENT DOCUMENTS

JP 59-78897 A 5/1984

(Continued)

*Primary Examiner*—Bruce H Hess
(74) *Attorney, Agent, or Firm*—Connolly Bove Lodge & Hutz LLP

(57) ABSTRACT

It is an object of the present invention to provide a sheet having a good transferring property, that is, a thermal transfer sheet which has high transfer sensitivity and good adhesion between a base material and a dye layer, and has high transfer sensitivity, and can be used for high speed printing and attain printed substance having a high density and sharpness, a protective layer transfer sheet which has a good transferring property and produces extremely low static electricity in transferring, and a printed substance which is superior in an antistatic property, plasticizer resistance and transparency.

The present invention pertains to a sheet including a base material, wherein said sheet is (I) a thermal transfer sheet formed by forming a base material, an under coat layer and a dye layer in this order, or (II) a protective layer transfer sheet including peelably a protection transfer layered body including a conductive layer in at least a part of the surface of a base material and said under coat layer and said conductive layer are formed by using colloidal inorganic pigment ultrafine particles.

17 Claims, 2 Drawing Sheets

FOREIGN PATENT DOCUMENTS

| | | | | |
|---|---|---|---|---|
| JP | 60-232996 | A | | 11/1985 |
| JP | 63-135288 | A | | 6/1988 |
| JP | 5-131760 | A | | 5/1993 |
| JP | 5-155150 | A | | 6/1993 |
| JP | 8-198989 | A | | 8/1996 |
| JP | 8-230032 | A | | 9/1996 |
| JP | 9175046 | A | | 7/1997 |
| JP | 11-105437 | A | | 4/1999 |
| JP | 11-156567 | A | | 6/1999 |
| JP | 11-188791 | A | | 7/1999 |
| JP | 2003-145946 | A | | 5/2003 |
| JP | 2003-312151 | A | | 11/2003 |
| JP | 2005-096200 | | * | 4/2005 |

* cited by examiner

THERMAL TRANSFER SHEET AND PROTECTIVE LAYER TRANSFER SHEET

CROSS-REFERENCE TO RELATED APPLICATIONS

This application is a National Stage of PCT/JP2005/019608 filed Oct. 25, 2005 which in turn claims priority from Japanese Applications 2004-309278, filed October 25, 2004, 2005-105349 filed Mar. 31, 2005 and 2005-105464 filed Mar. 31, 2005, disclosures of which are incorporated herein by reference.

TECHNICAL FIELD

The present invention relates to a thermal transfer sheet and a protective layer transfer sheet.

BACKGROUND ART

As a method of forming images using thermal transfer, a thermal diffusion dye transfer method (sublimation dye transfer printing method) of superimposing a thermal diffusion type thermal transfer sheet in which a thermal diffusion dye (sublimation dye) as a recording material is supported on a base of a plastic filmor the like on a thermal transfer image-receiving sheet in which a layer receiving the dye is provided on another base of paper, a plastic film or the like to form a full color image.

With respect to a thermal transfer recording method based on sublimation transfer, a problem that conventional thermal transfer sheets cannot attain sufficient print densities has arisen as a printing speed of a thermal transfer printer are becoming increasingly high.

As a thermal transfer sheet in which the print density is improved, a thermal transfer sheet in which an intermediate layer is provided between a base sheet and a dye layer is known.

As the thermal transfer sheet provided with the intermediate layer, there are known, for example, a thermal transfer sheet in which a hydrophilic barrier consisting of polyvinylpyrrolidone and polyvinyl alcohol is provided between a dye layer and a base sheet as an under coat layer, and a thermal transfer sheet in which an intermediate layer containing a sublimation dye having a diffusion coefficient smaller than that of a sublimation dye contained in a recording layer is provided between a base film and the recording layer containing a sublimation dye (See, for example, Japanese Kokai Publication Hei5-131760 and Japanese Kokai Publication Sho60-232996). However, there is a problem that a printed substance having an adequately high print density cannot be obtained in any thermal transfer sheet.

In Japanese Kokai Publication Sho59-78897, a thermal transfer sheet, in which a layer formed by vapor deposition of metal or metal oxide is formed on a base and on this layer, a thin layer of dye is provided, is described. However, there was a problem that this thermal transfer sheet cannot attain a printed substance having an adequately high print density, and it requires special equipment in vapor deposition and a production cost becomes high.

In Japanese Kokai Publication 2003-312151, a thermal transfer sheet, in which a good adhesive layer containing a homopolymer of N-vinylpyrrolidone or a copolymer of N-vinylpyrrolidone and another component is provided between the base and the dye layer, is described. This good adhesive layer may be a substance formed by mixing alumina, silica and like in addition to the polymers described above, but it is not essential to contain these compounds. In the thermal transfer sheet of Japanese Kokai Publication 2003-312151, there is a problem that the efficiency of dye transfer is insufficient.

In Japanese Kokai Publication Sho63-135288, an example, in which an ethanol solution or a 1-propanol solution of aminopropyltrialkoxysilane is applied to an interface as an under coat layer between the base of a thermal transfer sheet and the dye layer, is described. However, there is a problem that transfer sensitivity in printing at high speed is low since a relatively thick base is used.

In Japanese Kokai Publication Hei5-155150, a under coat layer formed by reacting a polymer having an inorganic primary chain comprising oxide of Group IVb metal with a copolymer such as acryloxyalkoxysilane is described. The under coat layer in Japanese Kokai Publication Hei5-155150 has a problem that it is low in heat resistance since it is an organic chain derived from the above copolymer and that it is prone to hydrolysis and unstable since it has the above inorganic primary chain.

In thermal diffusion type thermal transfer sheets, there was further a problem that when a plastic film is used as a base, a base is deteriorated and print wrinkles are produced due to heating and tension received during printing.

In order to solve this problem, in Japanese Kokai Publication Hei8-230032 and Japanese Kokai Publication Hei11-188791, a highly stretched base by a stretching method in which a draw ration in a machine direction (lengthwise) is enhanced, for example, a method of re-stretching in a machine direction in which the biaxially stretched film stretched lengthwise and crosswise is further stretched lengthwise again in processing a thin film base is described as a plastic film base.

However, since this highly stretched base requires a special film formation step, there is a problem that an increase in the cost cannot be avoided. Further, in recent years, there are tendencies that thermal damages to a base is increasing as a printing speed in a thermal transfer printer becomes higher, and a problem that conventional thermal transfer sheets are low in heat resistance and strength is arising.

On the other hand, it is performed that for the main purpose of imparting durability to images obtained by a thermal transfer method, a thermal transfer sheet, in which a protective layer is provided in advance for providing a protective layer on images later, is used, and this protective layer is transferred on images formed by a thermosensitive printer. However, there was a problem that when the protective layer is peeled off from the thermal transfer sheet, a large amount of static electricity is produced, and this causes carrying defects of a body on which the dye is transferred or a thermal transfer sheet in the thermosensitive printer.

In order to solve this problem, in Japanese Kokai Publication Hei11-105437, it is proposed that a protective layer (protection transfer layer) installed in a thermal transfer sheet includes an antistatic layer containing a surfactant, quaternary ammonium salt, and an antistatic agent of conductive metal oxide and the like such as zinc antimonite and the like and the antistatic agent may be contained in the protective layer composing the protection transfer layer or an adhesive layer. However, there are problems that when this antistatic agent is quaternary ammonium salt surfactant, quaternary ammonium salt is bled out to the outermost surface of the protection transfer layer with time to impair a transferring property and plasticizer resistance is deteriorated.

For the purpose of solving a problem of quaternary ammonium salt surfactant, a protective layer thermal transfer sheet, which is formed by providing a conductive protective layer containing a conductive inorganic substance obtained by treating a needle crystal of potassium titanate and the like with a conductive agent such as $SnO_2$/Sb, is proposed in Japanese Kokai Publication 2003-145946.

However, there is a problem that when a conductive agent is inorganic particles of metal oxides, if an amount of the conductive agent to be added is too much, the transparency of the protective layer is lost and opacity is produced.

All of the antistatic agents described above (conductive agents) need to form a layer together with a binder resin. However, an antistatic layer comprising a conductive agent using a binder resin has a problem (1) that since a mixing ratio have to be set in consideration of adhesion to a base sheet or another layer and an amount of the conductive agent to be added has a restraint, a certain amount of coating is required for achieving a desired antistatic power, and a problem (2) that a combination of the conductive agent with the binder has a restraint because the compatibility of the conductive agent with the binder have to be considered.

As a protective layer transfer film, a substance provided with a thermal transferring resin layer composed of a layered body prepared by forming a transparent resin layer, a plasticizer resistance resin layer, and a thermally adhesive resin layer in this order from a base film side is proposed. In Japanese Kokai Publication Hei11-156567 (claim 1, paragraph 31), it is said that when as the plasticizer resistance resin layer among the above substances, a resin formed by introducing ammonium salt, sulfonate salt, and acetate salt into an acrylic copolymerized resin as a polar group is used, this film is superior in an antistatic property. However, the plasticizer resistant resin layer in which a polar group is introduced into an acrylic copolymerized resin is inadequate in some cases.

Japanese Kokai Publication Hei5-131760
Japanese Kokai Publication Sho60-232996
Japanese Kokai Publication Sho59-78897
Japanese Kokai Publication 2003-312151
Japanese Kokai Publication Sho63-135288
Japanese Kokai Publication Hei5-155150
Japanese Kokai Publication Hei8-230032
Japanese Kokai Publication Hei11-188791
Japanese Kokai Publication Hei11-105437
Japanese Kokai Publication 2003-145946
Japanese Kokai Publication Hei11-156567

DISCLOSURE OF THE INVENTION

In view of the above-mentioned state of the art, it is an object of the present invention to provide a sheet having a good transferring property, that is, a thermal transfer sheet which has high transfer sensitivity and good adhesion between a base material and a dye layer, and can be used for high speed printing and attain printed substance having a high density and sharpness, a protective layer transfer sheet which has a good transferring property and produces extremely low static electricity in transferring, and a printed substance which is superior in an antistatic property, plasticizer resistance and transparency.

The present invention pertains to a sheet including a base material, wherein said sheet is (I) a thermal transfer sheet formed by forming a base material, an under coat layer and a dye layer in this order, or (II) a protective layer transfer sheet including peelably a protection transfer layered body including a conductive layer in at least a part of the surface of a base material and said under coat layer and said conductive layer are formed by using colloidal inorganic pigment ultrafine particles.

The present invention pertains to a thermal transfer sheet (herein after, also referred to as a "thermal transfer sheet (1)"), which comprises an under coat layer including colloidal inorganic pigment ultrafine particles and a dye layer formed in succession on a face on one side of a base material.

The present invention pertains to a thermal transfer sheet (herein after, also referred to as a "thermal transfer sheet (2)") formed by forming a base material, a primer layer and a dye layer in this order, wherein said primer layer is formed by using colloidal inorganic pigment ultrafine particles, and the strength of said base material, which is represented by a ratio [$S_1/S_2$] of breaking strength [$S_1$ (MPa)] to breaking elongation [$S_2$ (MPa)] along a longitudinal direction, is 3.5 or larger and smaller than 4.0

In the present specification, the above-mentioned thermal transfer sheet (1) and thermal transfer sheet (2) may be collectively called "a thermal transfer sheet of the present invention".

The present invention pertains to a protective layer transfer sheet, wherein said protective layer transfer sheet includes peelably a protection transfer layered body in at least a part of the surface of a base sheet and said protection transfer layered body includes a conductive layer formed by using colloidal inorganic pigment ultrafine particles.

The present invention pertains to a protective layer transfer sheet, wherein said protective layer transfer sheet includes peelably a protection transfer layered body in at least a part of the surface of a base sheet, said protection transfer layered body includes a conductive layer formed by using inorganic pigment ultrafine particles and said conductive layer does not contain a binder resin.

The present invention pertains to a printed substance, wherein a protection transfer layered body is transferred and formed so as to cover at least a part of an image surface using the protective layer transfer sheet of the present invention.

Hereinafter, the present invention will be described in detail.

The sheet of the present invention is the above-mentioned (I) thermal transfer sheet or the above-mentioned (II) protective layer transfer sheet, wherein said under coat layer and said conductive layer are formed by using the colloidal inorganic pigment ultrafine particles.

As the above-mentioned (I) thermal transfer sheet, the thermal transfer sheet of the present invention is given.

As the above-mentioned (II) protective layer transfer sheet, the protective layer transfer sheet of the present invention is given.

Since the sheet of the present invention has the under coat layer and the conductive layer formed by using the colloidal inorganic pigment ultrafine particles, it is characterized by having an excellent transferring property but its specific features will be shown in the description on the thermal transfer sheet of the present invention and the protective layer transfer sheet of the present invention.

1. Thermal Transfer Sheet (1)

The thermal transfer sheet (1) of the present invention has a constitution in which a heat resistant slipping layer 4*a* to enhance a slipping property of a thermal head and prevent sticking is provided on a face on one side of a base material 1*a*, and the under coat layer 2*a* comprising colloidal inorganic pigment ultrafine particles and the dye layer 3*a* are formed in succession on a face on the other side of the base material 1*a*, as the best embodiment is shown in FIG. 1.

Hereinafter, each layer constituting the thermal transfer sheet (1) of the present invention will be described in detail.

(Base Material)

As a base material of the thermal transfer sheet (1) used in the present invention, any material may be used as long as it is a publicly known material having a certain level of heat resistance and strength, and examples of the base materials include films of plastics, for example, polyesters such as polyethylene terephthalate [PET], polybutylene terephthalate [PBT], 1,4-polycyclohexylene dimethylene terephthalate, polyethylene naphthalate [PEN] and the like, polyolefins such as polyethylene, polypropylene and the like, polyamides such as aramide, nylon and the like, cellulose derivatives such as polyphenylenesulfide, polystyrene, polysulfone, polycarbonate, polyvinyl alcohol, cellophane, cellulose acetate and the like, polyvinyl chloride, polyvinylidene chloride, polyimide, fluororesin, and ionomer.

A thickness of the above base material is generally 0.5 to 50 μm, and preferably about 1 to 10 μm.

With respect to the above base material, the strength of a base, which is represented by a ratio [$S_1/S_2$] of breaking strength [$S_1$ (MPa)] to breaking elongation [$S_2$ (MPa)] along a longitudinal direction, is not particularly limited, but it is preferably 3.5 or larger and 5.0 or smaller, and more preferably 3.5 or larger and smaller than 4.0.

In the present specification, the above-mentioned breaking strength and breaking elongation were measured according to JIS C 2151.

In the above-mentioned, an adhesion treatment is often applied to the face on which the under coat layer comprising colloidal inorganic pigment ultrafine particles and the dye layer are formed. Aplastic film of the above-mentioned base material is preferably subjected to an adhesion treatment because when a thin layer of inorganic oxide is formed on the plastic film, the adhesion between the base material and the thin layer of inorganic oxide tends to be insufficient a little.

As the adhesion treatment, publicly known modification technologies of a resin surface such as a corona discharge treatment, a flame treatment, an ozone treatment, an ultra violet treatment, a radiation treatment, an etching treatment, a chemical treatment, a plasma treatment, a low temperature plasma treatment, a primer treatment, and a grafting treatment can be applied as-is. Further, these treatments can be used in combination of two or more species. The above-mentioned primer treatment can be performed, for example, by applying a primer solution to a not-yet-stretched film in forming a film by the melt extrusion of a plastic film and then stretching the film.

In the present invention, among the above-mentioned adhesion treatments, a corona discharge treatment and a plasma treatment which are not expensive and easily available are preferred in that these treatments enhance the adhesion between the base material and the under coat layer comprising the colloidal inorganic pigment ultrafine particles.

(Under Coat Layer Comprising Colloidal Inorganic Pigment Ultrafine Particles)

A publicly known compound can be used as colloidal inorganic pigment ultrafine particles for the under coat layer comprising colloidal inorganic pigment ultrafine particles provided between the base material and the dye layer in the thermal transfer sheet (1) of the present invention.

Examples of the above-mentioned colloidal inorganic pigment ultrafine particles include silica (colloidal silica); silicate metal salts such as aluminum silicate, magnesium silicate and the like; metal oxides such as alumina or alumina hydrate (alumina sol, colloidal alumina, cationic aluminum oxide or hydrate thereof, pseudo-boehmite), magnesium oxide, titanium oxide and the like; carbonate salts such as magnesium carbonate and the like; and the like. In the above thermal transfer sheet (1), particularly, colloidal silica and alumina sol are preferred, and alumina sol is more preferred.

Particle sizes of these colloidal inorganic pigment ultrafine particles are 100 nm or smaller in terms of an average primary particle diameter, preferably 50 nm or smaller, and it is particularly preferred to use the particles of 3 to 30 nm in diameter, and thereby the function of the under coat layer can be adequately exerted.

The colloidal inorganic pigment ultrafine particles in the present invention may take on any shape, for example, sphere form, acicular form, plate form, feather form, infinite form and the like. Further, colloidal inorganic pigment ultrafine particles, which are treated to be brought into an acid type, brought into cations in terms of charge, or surface treated for being easily dispersed in a water base solvent in sol form, can be used.

Moreover, it is preferred to provide fluidity for a coating solution for the under coat layer by adjusting the viscosity of the coating solution for the under coat layer down in consideration of the suitability for coating in the case of coating the under coat layer.

The under coat layer in the present invention has a structure comprising the above-mentioned colloidal inorganic pigment ultrafine particles, and it can be formed by applying a coating solution in which in organic pigment ultrafine particles are dispersed in a water solvent in sol form by publicly known means for forming a layer such as a gravure coating method, a roller coating method, a screen printing method, a reverse roll coating which uses a gravure and the like without using a resin as a binder and drying the coating solution.

The water solvent in the above-mentioned coating solution may be an aqueous solvent obtained by mixing alcohol such as isopropyl alcohol or the like in water. The above-mentioned coating solution is superior in dissolution stability and dispersion stability in contrast to a conventional method using alcohol only without using water, and it can be suitably employed as a coating solution.

In the above-mentioned coating solution, an amount of the colloidal inorganic pigment ultrafine particle is preferably 0.1 to 50 parts by weight with respect to 100 parts by weight of the coating solution.

The above-mentioned under coat layer may be a substance not containing a binder resin.

The under coat layer thus formed generally has an amount of coating of 0.02 to 1 g/m$^2$ or 0.02 to 1.0 g/m$^2$, preferably about 0.03 to 0.3 g/m$^2$, and more preferably about 0.1 g/m$^2$ as a dried amount of application.

The under coat layer in the present invention is formed by applying a coating solution, in which the above-mentioned inorganic pigment ultrafine particles are dispersed in a water solvent in sol form, on the base material, and drying the coating solution with hot air at temperatures of 90 to 130° C. to remove water so that the inorganic pigment ultrafine particles in sol form become gel form. Accordingly, the under coat layer in the present invention is not subjected to a baking treatment based on a common sol-gel method.

The under coat layer thus containing colloidal inorganic pigment ultrafine particles is formed as a coat between the base material and the dye layer, and it can enhance the adhesion between the base material and the dye layer and prevents the abnormal transfer of the dye layer to the thermal transfer image-receiving sheet when the under coat layer is heated in combination with the thermal transfer image-receiving sheet to perform the thermal transfer. Further, since the under coat layer is composed of colloidal inorganic pigment ultrafine particles which dye from the dye layer hardly dyes, it prevents the dye from transferring from the dye layer to the under coat layer in printing and performs effectively the dye diffusion to the receiving layer side of the thermal transfer image-receiving sheet, and thereby the under coat layer has the high transfer sensitivity in printing and can enhance a print density.

(Dye Layer)

The thermal transfer sheet (1) of the present invention has a constitution in which the dye layer is provided on the under coat layer formed on a face on one side of the base material, on a face on the other side of which the heat resistant slipping layer is provided. This dye layer can be composed of a single layer of one color or can be constructed by repeatedly forming a plurality of the dye layers including dyes having different hues sequentially on the same surface of the same base material.

The above-mentioned dye layer in the thermal transfer sheet (1) is a layer in which a thermally transferable dye is supported by an arbitrary binder.

Examples of the dyes used in the above thermal transfer sheet (1) include dyes fused, dispersed, or sublimated and transferred by heat, which are used in publicly known thermal transfer sheets of sublimation dye transfer, and any dye can be used in the present invention, but these dye are selected in consideration of a hue, a printing sensitivity, light resistance, a shelf life, and solubility in a binder.

The above-mentioned dye is not particularly limited and example of the dye include diaryl methane dyes; triaryl methane dyes; thiazole dyes; merocyanine dyes; methyne dyes such as pyrazolone methyne; indoaniline dye; azomethine dyes such as acetophenoneazomethine, pyrazoloazomethine, imidazoleazomethine, imidazoazomethine, and pyridoneazomethine; xanthene dyes; oxazine dyes; cyanostyrene dyes such as dicyanostyrene and tricyanostyrene dyes; thiazine dyes; azine dyes; acridine dyes; benzeneazo dye; azo dyes such as pyridoneazo, thiopheneazo, isothiazoleazo, pyrroleazo, pyrraleazo, imidazoleazo, thiadiazoleazo, triazoleazo and disazo; spiropyran dyes; indolinospiropyran dyes; fluoran dyes; rhodaminelactam dyes; naphthoquinone dyes; anthraquinone dyes; and quinophthalone dyes.

A binder in the above-mentioned dye layer is not particularly limited and publicly known resin binders can be used.

As the above-mentioned resin binder, cellulose resins such as methylcellulose, ethylcellulose, hydroxyethylcellulose, ethylhydroxy ethylcellulose, hydroxypropylcellulose, cellulose acetate and cellulose butyrate; vinyl resins such as poly vinyl alcohol, polyvinyl acetate, polyvinyl butyral, polyvinyl acetal, polyvinylpyrrolidone and polyacrylamide; polyester resins; phenoxy resin; and the like are preferred.

As the above-mentioned resin binder, among others, resins having high adhesion are more preferred because they can maintain the adhesion of the under coat layer to the dye layer even after leaving them in the conditions of elevated temperatures and high humidity. Examples of the above-mentioned resins having high adhesion include polyvinyl butyral, polyvinyl acetal, polyvinyl acetate, polyester resins, cellulose resins, and resins having a hydroxyl group, carboxyl group and the like.

Examples of the resin binders in the above-mentioned dye layer further include a releasable grafted copolymer. The above-mentioned releasable grafted copolymer can also be compounded together with the above-mentioned resin binders as a release agent.

The above-mentioned releasable grafted copolymer is formed by graft-polymerizing at least one species of a releasable segment selected from a polysiloxane segment, a carbon fluoride segment, hydrocarbon fluoride segments and long chain alkyl segments to a polymer principal chain constituting the resin binders described above.

As the above-mentioned releasable grafted copolymer, among others, a grafted copolymer obtained by grafting the polysiloxane segment to a principal chain consisting of polyvinyl acetal.

The above-mentioned dye layer may be formed by mixing a silane coupling agent in the dye layer in addition to the above-mentioned dye and the above-mentioned binder.

When the silane coupling agent is mixed in the above dye layer, it is thought that a silanol group produced by hydrolysis of the silane coupling agent is condensed with a hydroxyl group of an inorganic compound existing at the surface of the under coat layer, and thereby the adhesion between the dye layer and the under coat layer will be improved. Further, when the silane coupling agent has an epoxy group or an amino group, the silane coupling agent reacts with a hydroxyl group or a carboxyl group of a resin binder to chemically bond to these groups, and thereby the strength of the dye layer itself is enhanced and the break of the dye layer due to flocculation during thermal transfer can be prevented.

Examples of the above-mentioned silane coupling agent include isocyanate group-containing compounds such as γ-isocyanatepropyltrimethoxysilane and γ-isocyanatepropyltriethoxysilane; amino group-containing compounds such as γ-aminopropyltrimethoxysilane, γ-aminopropyltriethoxysilane, N-β-aminoethyl-γ-aminopropyltriethoxysilane and γ-phenylaminopropyltrimethoxysilane; and epoxy group-containing compounds such as γ-glycidoxypropyltrimethoxysilane and β-(3,4-epoxycyclohexyl) ethyltrimethoxysilane.

In the above-mentioned dye layer, the above-mentioned silane coupling agent may be mixed alone or in combination of two or more species.

The above-mentioned dye layer may be formed by mixing various publicly known additives in the dye layer in addition to the above dyes and the above binders, and the silane coupling agents to be added as desired.

Examples of the above-mentioned additives include polyethylene waxes to be added for improving a releasingproperty against a thermal transfer image-receiving sheet or coating suitability of ink, organic particles, and inorganic particles.

The above-mentioned dye layer can be generally formed by adding the above dye and the above binder, and the additives as required, to a proper solvent, and appropriately dissolving or dispersing the respective components in the solvent to prepare a coating solution for a dye layer, and then applying the resulting coating solution for a dye layer onto the under coat layer and drying it.

Examples of an application method of the above-mentioned dye layer include a gravure printing method, a screen printing method, a reverse roll coating which uses a gravure, but in particular, gravure coating is preferred.

The above-mentioned coating solution for a dye layer may be applied in such a way that a dried amount of application is preferably about 0.2 to 6 $g/m^2$ or about 0.2 to 6.0 $g/m^2$, and more preferably about 0.3 to 3 $g/m^2$ or about 0.3 to 3.0 $g/m^2$.

(Heat Resistant Slipping Layer)

In the thermal transfer sheet (1) of the present invention, a heat resistant slipping layer can be provided onto a face of the backside of the side of the base material on which the dye layer had been provided in order to prevent deleterious effects such as sticking, print wrinkles and the like due to heat from a thermal head.

A resin composing the above-mentioned heat resistant slipping layer may be publicly known resins, and examples of such resins include a polyvinyl butyral resin, a polyvinyl acetoacetal resin, a polyester resin, a vinyl chloride-vinyl acetate copolymer, a polyether resin, a polybutadiene resin, a styrene-butadiene copolymer, polyols such as acrylpolyol and the like, polyurethane acrylate, polyester acrylate, polyether acrylate, epoxyacrylate, a prepolymer of urethane or epoxy, a nitrocellulose resin, a cellulose nitrate resin, a cellulose acetate propionate resin, a cellulose acetate butyrate resin, a cellulose acetate hydrodiene phthalate resin, a cellulose acetate resin, an aromatic polyamide resin, a polyimide resin, a polyamideimide resin, a polycarbonate resin, and a chlorinated polyolefin resin.

The above-mentioned heat resistant slipping layer may be a substance formed by mixing an agent for a slipping property in addition to the above heat resistant resin in order to enhance a slipping property of a thermal head.

Examples of the above-mentioned agent for a slipping property include phosphate ester, metallic soap, silicone oil, graphite powder, a fluorine base graft polymer, and silicone polymers such as a silicone base graft polymer, an acrylsilicone graft polymer, acrylsiloxane and arylsiloxane.

In the above-mentioned heat resistant slipping layer, the above-mentioned agents for a slipping property may be mixed alone or in combination of two or more species.

The above-mentioned heat resistant slipping layer may be overcoated with the above-mentioned agent for a slipping property in place of being mixed with the above-mentioned agent for a slipping property.

The above-mentioned heat resistant slipping layer may be a substance formed by mixing additives such as a crosslinking agent, a release agent, organic powder and inorganic powder in addition to the heat resistant resins and the above agents for a slipping property, which are added as desired.

For example, when a crosslinking agent such as a polyisocyanate compound is mixed in the above heat resistant slipping layer, heat resistance, a coating property and adhesion can be improved. Further, when a release agent, organic powder, or inorganic powder is mixed in the above heat resistant slipping layer, a traveling property of a thermal head can be improved. Examples of the above-mentioned release agent include waxes, higher fatty acid amides, esters, and surfactants. Examples of the above-mentioned organic powder include fluororesins. Examples of the above-mentioned inorganic powder include silica, clay, talc, mica and calcium carbonate.

As the above heat resistant slipping layer, a substance comprising polyol, for example a polyol polymer compound, a polyisocyanate compound and a phosphate compound is preferred, and further a substance formed by adding a filler to these components is more preferred.

The heat resistant slipping layer can be formed by dissolving or dispersing the resins, the agents for a slipping property and fillers described above in a proper solvent to prepare a coating solution for a heat resistant slipping layer, and applying the resulting coating solution on a base sheet by means for forming a layer such as a gravure printing method, a screen printing method, a reverse roll coating method which uses a gravure and the like, and drying the coating solution. An amount of coating of the heat resistant slipping layer is preferably 0.1 to 3 g/m$^2$ or 0.1 to 3.0 g/m$^2$ on a solid content basis.

(Others)

The thermal transfer sheet (1) of the present invention may be a substance in which the protection transfer layer and the dye layer are provided sequentially on the same face as that of the base sheet on which the dye layer is provided as with the thermal transfer sheet (2) of the present invention described later.

The thermal transfer sheet (1) of the present invention can form desired images on a material on which the dye is transferred such as a thermal transfer image-receiving sheet using a publicly known thermosensitive printer.

2. Thermal Transfer Sheet (2)

The thermal transfer sheet (2) of the present invention is, for example as shown in FIG. 2, constructed by formed a primer layer 2*b* and a dye layer 3*b* in this order from a base side on one surface of a base material 1*b*. Further, a heat resistant slipping layer 4*b* may be provided on the other surface of a base material 1*b*.

Hereinafter, each layer constituting the thermal transfer sheet (2) of the present invention will be described.

(Base Material)

The base material in the present invention is a substance of which the strength of a base, represented by a ratio [$S_1/S_2$] of breaking strength [$S_1$ (MPa)] to breaking elongation [$S_2$ (MPa)] along a longitudinal direction, is 3.5 or larger and smaller than 4.0.

The above-mentioned base material having higher strength of a base has higher strength and higher heat resistance.

As a conventional base material used for the thermal transfer sheet, base materials, in which the above-mentioned strength of a base is high, preferably 4.0 or more, have been selected from the viewpoint of preventing troubles such as print wrinkles resulting from heating during printing. However, the thermal transfer sheet (2) of the present invention can print at low energy since it has high transfer sensitivity as described later, and therefore it becomes possible to use a base material having a relatively low strength of a base like the above-mentioned range and even when such a base material is used, troubles due to heating or tension at the time of printing hardly occurs.

As the base material in the present invention, a plastic film exemplified in the thermal transfer sheet (1) described above is preferred, and among others, a polyester film and a polyolefin film are more preferred, and a PET film, a PBT film, and a PEN film are furthermore preferred.

At the time of this application, it is thought that as a base material in a thermal diffusive thermal transfer sheet, it is necessary to use a highly stretched base material such as a film which is biaxially stretched and further stretched in a machine direction (re-stretching in a machine direction) from the viewpoint of improving the strength of a base based on the definition described above, but since the base material in the thermal transfer sheet (2) may have low strength of a base, for example, even a film which has been biaxially stretched but is not subjected to re-stretching can form a thermal transfer film having excellent transfer sensitivity.

A thickness of a base material in the above-mentioned thermal transfer sheet (2) can be appropriately set in accordance with its species in such away that its strength and heat resistance become appropriate, but the thickness is preferably about 2.5 to 6 μm or about 2.5 to 6.0 μm, and a more preferable lower limit is 4 μm or 4.0 μm and a more preferable upper limit is 5.5 μm.

Although the strength of a base based on the definition described above generally has a tendency to decrease as the thickness of a base material becomes small, the thickness of the base material in the thermal transfer sheet (2) can be reduced because the base material may be used as long as the strength of a base falls within the above range.

In the present invention, the above-mentioned thickness of a base material is determined by calculation from values obtained by measuring a thickness of ten thicknesses of base materials with a micrometer (MFC-191 manufactured by Nikon Corporation).

The above-mentioned base material is not particularly limited and it may be substances having subjected to various surface treatments such as the treatment for good adhesion for the purpose of improving adhesion to a primer layer.

The above-mentioned treatment for good adhesion can be performed, for example, by applying resins described later onto a base material and curing the resins.

Examples of resins used for the above-mentioned treatment for good adhesion include polyester resins, acrylic resins, urethane resins, and alkyd resins. In the above treatment for good adhesion, melamine compounds, isocyanate compounds, epoxy compounds, compounds containing an oxazoline group, or chelate compounds may be added to the above resins.

An amount of coating of the good adhesive layer formed by the above-mentioned treatment for good adhesion is preferably is 0.1 g/m$^2$ or less as a dried amount of application. In point of a traveling property of a thermal head and the protection of printing unevenness, unevenness of an amount of coating of the good adhesive layer is preferably within ±5% of an average amount of coating in both of a MD direction and a TD direction, for example, when the base material is a stretched film.

(Primer Layer)

The primer layer in the thermal transfer sheet (2) of the present invention is formed between the above base material and a dye layer described later.

The above-mentioned primer layer may be formed on a base material, or may be formed on the above good adhesive layer formed on a base material, but it is preferably located immediately below the dye layer.

The primer layer in the above-mentioned thermal transfer sheet (2) is formed by using the colloidal inorganic pigment ultrafine particles.

As the above-mentioned colloidal inorganic pigment ultrafine particles, publicly known compounds described above can be used, but in the above-mentioned primer layer, metal oxides and carbonate salts are preferred, metal oxides are more preferred, and alumina or alumina hydrate is furthermore preferred, and among others, alumina sol is most preferred. In the above-mentioned primer layer, colloidal silica can also be suitably used as a colloidal inorganic pigment ultrafine particles.

The above-mentioned primer layer may be formed by using only one species of the above-mentioned colloidal inorganic pigment ultrafine particles or using two or more species in combination.

The colloidal inorganic pigment ultrafine particles in the primer layer may take on any shape, but an average particle diameter of the particles preferably falls within the same range as that of the particles used in the thermal transfer sheet (1) described above from the viewpoint of the strength of a thermal transfer sheet to be obtained, and the colloidal inorganic pigment ultrafine particles may be one subjected to various treatments described above for being easily dispersed in a water base solvent in sol form.

The above-mentioned colloidal inorganic pigment ultrafine particles in the primer layer may be commercially available articles such as Alumina Sol 100 (produced by Nissan Chemical Industries, Ltd.), Alumina Sol 200 (produced by Nissan Chemical Industries, Ltd.), and the like.

The above-mentioned primer layer may have various pigments, dyes, fluorescent brighteners, and another additives to the extent not impairing transfer sensitivity in accordance with the intended use such as a whiteness degree, addition of the ability to hide and toning.

The above-mentioned primer layer can be formed by applying a coating solution for a primer layer, in which for example, the colloidal inorganic pigment ultrafine particles are dispersed in an aqueous medium, on the base material or the above-mentioned good adhesion layer, and drying the coating solution.

The above-mentioned coating solution for a primer layer does not have to contain water, but this coating solution is preferably a substance containing water or may be a substance containing water and a water-soluble organic solvent. When the coating solution for a primer layer contains water, it is superior in dissolution stability and dispersion stability in contrast to a conventional method, for example, using alcohol only without using water, and it can be suitably employed as a coating solution.

In the above-mentioned coating solution for a primer layer, an amount of the colloidal inorganic pigment ultrafine particles is preferably 0.1 to 50 parts by weight with respect to 100 parts by weight of the coating solution, and more preferably 20 parts by weight or less.

The above-mentioned primer layer may be a substance not containing a binder resin.

In the present invention, the coating solution for a primer layer can be applied in an amount within a range of 0.05 to 10 g/m$^2$ as a dried amount of application, but the coating solution is preferably applied in an amount which becomes 0.05 g/m$^2$ or more after drying from the viewpoint of attaining a thermal transfer sheet having the excellent transfer sensitivity and strength, and preferably applied in an amount which becomes 5 g/m$^2$ or less, more preferably 3 g/m$^2$ or less, after drying from the viewpoint of the production cost.

That is, the primer layer in the present invention can attain a thermal transfer sheet having excellent strength even though the primer layer contains a less amount of the colloidal inorganic pigment ultrafine particles than that of a conventional primer layer not using the colloidal inorganic pigment ultrafine particles.

The above-mentioned drying may be generally carried out through hot air drying so that the colloidal inorganic pigment ultrafine particles in sol form become dried gel form. Since the primer layer in the present invention is formed through the above-mentioned drying step, the colloidal inorganic pigment ultrafine particles within the primer layer is in a state of fixation and therefore the primer layer has excellent heat resistance and strength.

(Dye Layer)

The dye layer in the thermal transfer sheet (2) of the present invention has the same constitution and production method as those of the dye layer in the thermal transfer sheet (1) described above. The above-mentioned thermal transfer sheet (2) is preferably a thermal diffusion type.

(Heat Resistant Slipping Layer)

In the thermal transfer sheet (2) of the present invention, a heat resistant slipping layer may be provided onto a face of the backside of the side of the base material on which the above-mentioned primer layer or the like is formed.

The above-mentioned heat resistant slipping layer is provided in order to prevent problems such as sticking, print wrinkles, and the like, which arise due to heat from a thermal head in performing thermal transfer.

The heat resistant slipping layer in the above thermal transfer sheet (2) comprises a heat resistant resin, and has the same constitution as the heat resistant resin layer in the thermal transfer sheet (1).

The above-mentioned heat resistant slipping layer is generally formed by mixing an agent for a slipping property in addition to the above heat resistant resin in order to enhance a slipping property of a thermal head. In addition, the above-mentioned heat resistant slipping layer may be overcoated with the above-mentioned agent for a slipping property in place of being mixed with the above-mentioned agent for a slipping property. The above-mentioned heat resistant slipping layer may be a substance formed by mixing various additives in addition to the heat resistant resins and the above agents for a slipping property, which are added as desired, as with the thermal transfer sheet (1).

The heat resistant slipping layer in the above thermal transfer sheet (2) can be formed by applying a coating solution for a heat resistant slipping layer onto a face of the backside of the side of the base material on which the dye layer is provided, and drying the coating solution.

The above-mentioned coating solution for a heat resistant slipping layer can be generally formed by adding the heat resistant resins described above and the above agents for a slipping property and the above additives, which are added as required, to a proper solvent, and dissolving or dispersing the respective components in the solvent to prepare a coating solution for a heat resistant slipping layer, and then applying the resulting coating solution for a heat resistant slipping layer onto a base material and drying it.

Examples of an application method of the above-mentioned coating solution for a heat resistant slipping layer include the methods exemplified in coating of the dye layer described above, but in particular, gravure coating is preferred.

The above-mentioned coating solution for a heat resistant slipping layer may be applied in such a way that a dried amount of application is preferably about 0.1 to 3 g/m$^2$, and more preferably 1.5 g/m$^2$ or less.

(Protection Transfer Layer)

The thermal transfer sheet (2) of the present invention may be a substance in which the protection transfer layer and the dye layer are provided sequentially on the same face as that of the base sheet on which the dye layer is provided.

The above-mentioned protection transfer layer is not particularly limited, and examples of the protection transfer layers include publicly known substances composed of a layered body prepared by forming a transparent resin layer, a plasticizer resistance resin layer, and a thermally adhesive resin layer in this order from a base material side. The above-mentioned protection transfer layer may contain a conductive layer in place of the above-mentioned plasticizer resistance resin layer.

The respective resins in the above-mentioned transparent resin layer, plasticizer resistance resin layer and thermally adhesive resin layer are not particularly limited as long as they are not deteriorated in printing, and publicly known resins can be used. Examples of the above conductive layer include a conductive layer formed by using the colloidal inorganic pigment ultrafine particles described above.

The protection transfer layer in the above-mentioned thermal transfer sheet (2) is preferably a protection transfer layered body constituting a protective layer transfer sheet of the present invention described later.

(Print)

The thermal transfer sheet (2) of the present invention can form desired images on a material on which the dye is transferred such as a thermal transfer image-receiving sheet using a publicly known thermosensitive printer. Further, when the thermal transfer sheet (2) of the present invention also includes a protection transfer layer, it can transfer the protection transfer layer to a desired region in addition to the desired image.

The above-mentioned thermal transfer image-receiving sheet is not particularly limited and it includes, for example, a substance formed by providing a receiving layer having a dye-receiving property on a publicly known base material.

Examples of a base material in the above-mentioned thermal transfer image-receiving sheet include plain paper, bond paper, tracing paper, and a plastic film, but it is not particularly limited.

The receiving layer in the above-mentioned thermal transfer image-receiving sheet can be formed by a coating method or a formation method by a thermal head or a heat roller. Further, the above thermal transfer image-receiving sheet does not need the installation of the receiving layer if the base material itself has a dye-receiving property.

The above-mentioned thermal transfer image-receiving sheet may take on any form of a card, a postcard, a passport, a sheet of letter paper, a sheet of writing paper, a notebook, and a catalog.

Printing conditions in the present invention is not particularly limited and can be appropriately set in accordance with the constitutions of a thermal transfer sheet (2), a thermal transfer image-receiving sheet and the like to be used.

Since the thermal transfer sheet (2) of the present invention has excellent transfer sensitivity as describe above, a printed substance having a high print density can be obtained even if printing is performed at low energy, and troubles such as print wrinkles hardly occur even when a printing speed is high.

The thermal transfer sheet (2) of the present invention can produce a printed substance equal in a print density to that obtained from a conventional thermal diffusion type thermal transfer sheet with energy of 80% relative to conventional energy level.

3. Protective Layer Transfer Sheet

As shown for example in FIG. 3, the protective layer transfer sheet of the present invention, as an aspect thereof, includes a protection transfer layered body 3*c* on a face on one side of a base sheet 1*c* and a heat resistant slipping layer 7*c* is provided on the other face of the base sheet 1*c*. In the aspect shown in FIG. 3, the above-mentioned protection transfer layered body 3*c* is formed by forming a protective layer 4*c*, a conductive layer 5*c* and an adhesive layer 6*c* in this order from the base sheet side.

In the protective layer transfer sheet of the present invention, the above protection transfer layered body 3*c* may be a substance provided on a release layer 2*c* formed on the base sheet 1*c* as shown for example in FIG. 4.

In addition, when a releasing property of the base sheet 1*c* from the protection transfer layered body 3*c* is good, the formation of the above-mentioned release layer 2*c* is not essential.

Hereinafter, each layer constituting the protective layer transfer sheet of the present invention will be described.

(Base Sheet)

As the base sheet in the protective layer transfer sheet of the present invention, the same base sheet as that used in conventional thermal transfer sheets can be used as-is. The above-mentioned base sheet is not particularly limited and it may be substances having subjected to various surface treatments such as the treatment for good adhesion.

As the above-mentioned base sheet, for example, films of plastics such as polyesters such as polyethylene terephthalate (PET) and the like, polycarbonate, polyamide, polyimide, cellulose acetate, polyvinylidene chloride, polyvinyl chloride, polystyrene, fluororesin, polypropylene, polyethylene and ionomer; papers such as glassine paper, capacitor paper, paraffin paper and the like; and cellophane are preferred.

Moreover, the above base sheet may be a composite film formed by forming two or more species of the above plastic films, papers and cellophane.

A thickness of the above-mentioned base sheet can be appropriately set in accordance with its material in such a way that its strength and heat resistance become appropriate, but the thickness is preferably about 2.5 to 100 μm.

(Release Layer)

In the protective layer transfer sheet of the present invention, it is preferred to provide a release layer in an area of the surface of the base sheet, on which a protection transfer layered body is formed for the purpose of making the transferring property of the protection transfer layered body favorable.

As a resin composing the above-mentioned release layer, any resin may be used as long as it is a publicly known releasable resin, and example of these resins include waxes, silicone wax, a silicone resin, a silicone modified resin, a fluororesin, a fluorine modified resin, polyvinyl alcohol, a acrylic resin, a thermally crosslinking epoxy-amino resin, and a thermally crosslinking alkyd-amino resin.

In the present invention, the above release layer may consist of one species of a resin or may consist of two or more species of resins.

The above-mentioned release layer can be formed by applying a coating solution for a release layer, in which, for example, the above-mentioned releasable resin is dissolved in a solvent, to an area of the surface of the base sheet, on which a protection transfer layered body is formed, in such a way that a dried layer thickness is about 0.5 to 5 μm by a publicly known method such as gravure coating, gravure reverse coating or the like, and drying the coating solution.

The above-mentioned coating solution for a release layer can be prepared by dissolving the above releasable resin and a crosslinking agent or a catalyst to be mixed as required in a proper solvent such as methyl ethyl ketone, toluene, or isopropyl alcohol. The above-mentioned coating solution for a release layer preferably has a solid content of about 5 to 50% by weight.

The above release layer can be appropriately selected from (1) a release layer transferred to a body on which the dye is transferred during thermal transfer, (2) a release layer remaining on a base sheet side after thermal transfer (untransferable), and (3) a release layer breaking due to flocculation during thermal transfer, but (2) the untransferable release layer is preferred from the viewpoint of surface gloss and transferring stability of a protection transfer layered body. In the protective layer transfer sheet of the present invention, when the protection transfer layered body is provided on an untransferable release layer formed on a base sheet, the protection transfer layered body is transferred on the image formed on a body on which the dye is transferred to become a protective layer of the image in thermal transfer, but since the release layer remains on the base sheet side, the antistatic property and the transparency of a printed substance to be obtained can be improved.

When it is desired that a protective layer after transfer is matted, it is also possible to make the surface of the protective layer matted by including various particles in the release layer or matting the surface of the protective layer side of the release layer.

(Protection Transfer Layered Body)

The protective layer transfer sheet of the present invention includes peelably a protection transfer layered body in at least a part of the surface of a base sheet.

The above-mentioned protection transfer layered body is generally formed by forming (I) a protective layer, (II) a conductive layer and (III) an adhesive layer in this order from a base sheet side on one surface of a base sheet.

As a material of the above-mentioned (I) protective layer, any resin publicly known can be generally used as long as the resin is superior in durability and transparency for transferring the protective layer onto the images in order to protect the images formed on a body on which the dye is transferred.

Examples of a resin in the above (I) protective layer include acrylic resins, cellulose resins, polyvinyl acetal resins, and polyester resins.

The above-mentioned (I) protective layer can be formed by applying a coating solution for a protective layer, in which, for example, the above-mentioned resin is dissolved or dispersed in a proper solvent or a proper dispersion, onto the surface of the release layer in such a way that a dried layer thickness is about 0.5 to 5 $g/m^2$ by a publicly known method described above, and drying the coating solution.

The above-mentioned coating solution for a protective layer can be prepared by the same method as in the coating solution for a release layer described above. Preferably, the above-mentioned protective layer does not contain a quaternary ammonium salt base surfactant from the viewpoint of a transferring property.

The above-mentioned (II) conductive layer is formed by using the colloidal inorganic pigment ultrafine particles as a first aspect in the protective layer transfer sheet of the present invention. In the protective layer transfer sheet of the present invention, since the above (II) conductive layer is formed by using the colloidal inorganic pigment ultrafine particles, the gas barrier property and the transferring property of the protection transfer layered body are excellent and plasticizer resistance is high.

Examples of the above colloidal inorganic pigment ultrafine particles include substances exemplified in connection with the thermal transfer sheet (1) described above, but among others, a conductive colloidal inorganic pigment ultrafine particle is preferred.

As the above-mentioned conductive colloidal inorganic pigment ultrafine particle, publicly known compounds such as silicate metal salts such as aluminum silicate, magnesium silicate and the like; metal oxides such as alumina or alumina hydrate (alumina sol, colloidal alumina, cationic aluminum oxide or hydrate thereof, pseudo-boehmite), magnesium oxide, titanium oxide and the like; carbonate salts such as magnesium carbonate and the like; and the like can be used, but metal oxides and carbonate salts are preferred, metal oxides are more preferred, alumina or alumina hydrate is furthermore preferred, and alumina sol is particularly preferred.

The above (II) conductive layer, which is the first aspect in the protective layer transfer sheet, does not need to contain a binder resin since it is formed by using the colloidal inorganic pigment ultrafine particles, and preferably, the (II) conductive layer does not contain the binder resin in order to reduce an application amount of a coating solution for a conductive layer.

In the present invention, the above colloidal inorganic pigment ultrafine particles may be one treated to be brought into an acid type by compounding a dispersion stabilizer such as hydrochloric acid or acetic acid, or one brought into cations in terms of charge, or one surface treated for being easily dispersed in a water base solvent in sol form.

The colloidal inorganic pigment ultrafine particles in the present invention may be commercially available articles, for example, Alumina Sol 100 (produced by Nissan Chemical Industries, Ltd.), Alumina Sol 200 (produced by Nissan Chemical Industries, Ltd.), and the like.

The (II) conductive layer in the present invention is formed by using the inorganic pigment ultrafine particles as a second aspect in the protective layer transfer sheet of the present invention and may be a substance not containing the binder resin. As the above-mentioned inorganic pigment ultrafine particles, a conductive needle crystal inorganic substance described in Japanese Kokai Publication 2003-145946 may be used in addition to the colloidal inorganic pigment ultrafine particles described above, but the colloidal inorganic pigment ultrafine particle is preferably used in that it has an excellent film-formation property without using a binder resin, and the conductive inorganic pigment ultrafine particle is preferably used in that it has excellent conductivity and the conductive colloidal inorganic pigment ultrafine particle is more preferably used.

The above-mentioned (II) conductive layer may be formed by using one species or two or more species of the above-mentioned colloidal inorganic pigment ultrafine particles in the first aspect in the protective layer transfer sheet of the present invention, or may be formed by using one species or two or more species of the above-mentioned inorganic pigment ultrafine particles in the second aspect in the protective layer transfer sheet of the present invention.

An average particle diameter of the above-mentioned inorganic pigment ultrafine particles including the colloidal inorganic pigment ultrafine particles is normally 100 nm or smaller, preferably 50 nm or smaller, and particularly preferably 3 to 30 nm.

When the average particle size of the above-mentioned inorganic pigment ultrafine particles including the colloidal inorganic pigment ultrafine particles falls within the above-mentioned range, a protective layer transfer sheet having an extremely excellent antistatic property can be obtained.

In the present specification, when it is not clearly described whether the (II) conductive layer is the first aspect in the protective layer transfer sheet of the present invention or the second aspect, it means that the description on the (II) conductive layer is common to the first aspect and the second aspect in the protective layer transfer sheet of the present invention.

The above-mentioned (II) conductive layer may have various pigments, dyes, fluorescent brighteners, and another additives to the extent not impairing electric conductivity in accordance with the intended use such as a whiteness degree, addition of the ability to hide and toning.

The above-mentioned (II) conductive layer can be formed by applying a coating solution for a conductive layer, in which the above-mentioned inorganic pigment ultrafine particles are dispersed in an aqueous medium in sol form, on the above-mentioned (I) protective layer, and drying the coating solution.

Examples of the aqueous medium in the above-mentioned coating solution for a conductive layer include water, water-soluble alcohols such as isopropyl alcohol or the like, and a mixed solution of water and water-soluble alcohol.

In the above-mentioned coating solution for a conductive layer, an amount of the inorganic pigment ultrafine particle is preferably 1 to 300 parts by weight with respect to 100 parts by weight of the aqueous medium.

Since the above-mentioned (II) conductive layer may be a substance not containing a binder resin, it can attain desired electric conductivity with a less amount of application compared with a conductive layer formed by conventional coating solutions for a conductive layer formed by dispersing a conductive agent in a binder resin. Since the protective layer transfer sheet of the present invention has the (II) conductive layer which can be formed with a less amount of application, it can transfer a highly transparent protective layer to a body on which the dye is transferred.

The above-mentioned coating solution for a conductive layer can be applied in an amount within a range of 0.1 to 10 $g/m^2$ as a dried amount of application, but the coating solution can be applied in an amount which becomes preferably 0.15 $g/m^2$ or more, more preferably 0.2 $g/m^2$ or more, after drying from the viewpoint of providing an excellent antistatic property, and can be applied in an amount which preferably becomes 5 $g/m^2$ or less, more preferably 3 $g/m^2$ or less, after drying from the viewpoint of being sufficient for an antistatic property.

The above-mentioned drying may be generally carried out through hot air drying so that the inorganic pigment ultrafine particles in sol form become gel form.

The above-mentioned (III) adhesive layer is formed on a face on the backside of the side of the above-mentioned (II) conductive layer to which contact with the base sheet and has a function of improving the adhesion of a protection transfer layered body after being transferred to a body on which the dye is transferred.

The above-mentioned (III) adhesive layer can be formed from any publicly known thermosensitive adhesive, but is preferably formed from thermoplastic resins having a glass transition temperature of 50 to 80° C.

Examples of the above-mentioned thermoplastic resin include ultra violet absorbing resins, an acrylic resin, a vinyl chloride-vinyl acetate copolymer resin, an epoxy resin, a polyester resin, a polycarbonate resin, a butyral resin, a polyamide resin, and a vinyl chloride resin.

The above-mentioned (III) adhesive layer can be formed in the same way as in the above release layer.

In the protective layer transfer sheet of the present invention, the protection transfer layered body exhibits a surface resistivity within the range of $1\times10^5\Omega/\square$ to $1\times10^{10}\Omega/\square$ preferably $1\times10^6\Omega/\square$ to $5\times10^9\Omega/\square$ under the circumstances of 23° C., relative humidity 60 percent.

In the present specification, the surface resistivity of the above-mentioned protection transfer layered body is a value obtained by measuring the surface of the protection transfer layered body before forming an image with a high-resistivity meter (Hiresta IP MCP-HT 250 manufacture by DIA INSTRUMENTS CO., LTD.) under the circumstances of 23° C., relative humidity 60 percent according to JIS K 6911.

Since the protective layer transfer sheet of the present invention has the protection transfer layered body exhibiting a surface resistivity within the above-mentioned range, it has an excellent antistatic property and hardly causes troubles such as occurrence of static electricity in transferring the dye to a body on which the dye is transferred (Heat Resistant Slipping Layer)

A heat resistant slipping layer in the protective layer transfer sheet of the present invention is formed on a face on the backside of the side of the above base sheet on which a protection transfer layered body is provided using a thermoplastic resin for the purpose of improving heat resistance and a traveling property of a thermal head in printing.

As the above-mentioned thermoplastic resin, thermoplastic resins such as polyester resins; polyacrylic ester resins; polyvinyl acetate resins; styrene acrylate resins; polyurethane resins; polyolefin resins like polyethylene resins and polypropylene resins; polystyrene resins; polyvinyl chloride resins; polyether resins; polyamide resins; polyimide resins; polyamideimide resins; polycarbonate resins; polyacrylate resin; polyacrylamide resin; polyvinyl chloride resin; polyvinyl butyral resin; polyvinyl acetal resins like polyvinyl acetoacetal resin; and the like, and silicone modified products thereof are preferred, and polyamideimide resins and silicone modified products thereof are more preferred in point of heat resistance.

The above-mentioned heat resistant slipping layer may be mixed with various additives, for example, thermal release agents such as waxes, higher fatty acid amides, esters, metallic soaps, silicone oils and surfactants; organic powders such as fluororesins; inorganic particles such as silica, clay, talc and calcium carbonate; and the like for the purpose of improving a slipping property in addition to the above thermoplastic resins.

The above-mentioned heat resistant slipping layer can be formed by preparing a coating solution for a heat resistant slipping layer, and applying and drying this coating solution.

The above-mentioned coating solution for a heat resistant slipping layer may be composed of only the above thermoplastic resin, or may be formed by adding an additive to be added as desired in addition to the above thermoplastic resin.

A thickness the above-mentioned heat resistant slipping layer is preferably 2 $g/m^2$ or less, and more preferably 0.1 to 1 $g/m^2$ on a solid content basis from the viewpoint of attaining a protective layer transfer sheet having excellent heat resistance.

(Colored Thermal Transfer Layer)

The protective layer transfer sheet of the present invention may be a substance in which only the above-mentioned protection transfer layered body is provided on a base sheet, but it may be a substance in which above-mentioned protection transfer layered body and colored thermal transfer layer are provided sequentially on the same face of the base sheet.

That is, the protective layer transfer sheet of the present invention may include the above protection transfer layered body located at a part of the surface of a base sheet and have the colored thermal transfer layer, a sublimation dye layer having one or more colors or a thermofusible color material layer having one or more colors, which is arranged sequentially together with the above protection transfer layered body on the above surface of the base sheet.

When the protective layer transfer sheet of the present invention also includes the colored thermal transfer layer which is arranged sequentially together with the above protection transfer layered body on the base sheet, it can form desired images on a material on which the dye is transferred and transfer the protection transfer layered body to a desired image region using a thermosensitive printer.

The above-mentioned sublimation dye layer can be formed from a publicly known sublimation dye and a publicly known binder resin by a publicly known method, and it can be formed in the same way as in, for example, the above thermal transfer sheet (1).

The above-mentioned thermofusible color material layer can be formed from a publicly known pigment and a publicly known thermofusible material such as wax by a publicly known method.

Examples of the protective layer transfer sheets of the present invention also include a protective layer transfer sheet which is a thermal transfer sheet, including the protection transfer layered body located at a part of the surface of a base sheet and having the colored thermal transfer layer, a sublimation dye layer having one or more colors or a thermofusible color material layer having one or more colors, arranged sequentially together with the protection transfer layered body on the surface of the base sheet, wherein the protection transfer layered body includes a conductive layer and further a protective layer, and the protection transfer layered body is formed by providing the conductive layer on the whole surface on the side of the protective layer of the layered body formed by providing the protective layer at a part of the surface on one side of the base sheet and then providing the colored thermal transfer layer in a region on the conductive layer, below which the protective layer is not positioned.

The constitutions of the respective layers such as the base material, the conductive layer and the colored thermal transfer layer in the above-mentioned protective layer transfer sheet are similar to those in the protective layer transfer sheet described above.

Since the above-mentioned protective layer transfer sheet has the above-mentioned conductive layer, it has good adhesion between the base material and the colored thermal transfer layer, and can perform thermal transfer at high speed, and does not cause abnormal transfer of the colored thermal transfer layer to an image-receiving sheet.

In the preferable embodiment of the protective layer transfer sheet described above, for example as shown in FIG. 5, a protective layer 4*d* is provided partially on one side of a base material 2*d*, and a conductive layer 3*d* is provided throughout the whole area on the protective layer 4*d* and on the base material 2*d* on which the protective layer 4*d* is not provided. Moreover, an adhesive layer 7*d* may be provided in a region on the conductive layer 3*d* below which the protective layer 4*d* is positioned, and in this case, three layers of the protective layer 4*d*, the conductive layer 3*d* and the adhesive layer 7*d* are transferred to a body on which the dye is transferred as a protection transfer layered body 6*d*. Further, a heat resistant slipping layer 10*d* may be provided onto a face of backside of the side of the base material 2*d* on which the protective layer 4*d* is provided, and the installation of the heat resistant slipping layer enables to prevent thermal adhesiveness to a thermal head and improve a traveling property of a thermal head.

Further, when an adhesive layer 7*d* is provided on the outermost surface of the protection transfer layered body 6*d*, the transferring property to and the adhesion to a body on which the dye is transferred are improved. Further, it is preferred that in an area which is different from a region where the protection transfer layered body 6*d* is formed, a colored thermal transfer layer, preferably a yellow dye layer (Y), a magenta dye layer (M), and a cyan dye layer (C) of a colored thermal transfer layer 5*d* are provided in sequence on a face between the protection transfer layered body 6*d* and the next protection transfer layered body 6*d*, and a unit 9*d* (not shown) consisting of the colored thermal transfer layer 5*d* of three colors and the protection transfer layered body 6*d* is repeatedly formed in the longitudinal direction of the protective layer transfer sheet. Further, a detection mark 8*d* may be placed between the yellow dye layer (Y) and the magenta dye layer (M), between the magenta dye layer (M) and the cyan dye layer (C), and between the cyan dye layer (C) and the protection transfer layered body 6*d*, and between the protection transfer layered body 6*d* and the yellow dye layer (Y).

The above-mentioned protective layer 4*d*, adhesive layer 7*d* and detection mark 8*d* can have the composition which is publicly known, and can have the same composition as that of, for example, Japanese Kokai Publication 2003-312151.

(Transfer etc.)

When the protective layer transfer sheet of the present invention also includes the above-mentioned colored thermal transfer layer in addition to the protection transfer layered body, it can form images on a body on which the dye is transferred such as a thermal transfer image-receiving sheet and further transfer the protection transfer layered body.

In the present invention, the above-mentioned protection transfer layered body may be transferred to the whole area or to a specific area of the formed images.

A printed substance, wherein a protection transfer layered body is transferred and formed so as to cover at least a part of an image surface using the protective layer transfer sheet of the present invention, also constitutes the present invention.

Since the protection transfer layered body in the printed substance of the present invention is formed by using the protective layer transfer sheet of the present invention and has the conductive layer (II) formed by using the inorganic pigment ultrafine particles, it has an excellent gas barrier property and high plasticizer resistance. Accordingly, the printed substance of the present invention hardly causes the dye in a dye receiving layer to transfer and can maintain images even when it maintains contact with a resin containing a plasticizer such as polyvinyl chloride for a long time.

The thermal transfer image-receiving sheet which can be used for the above-mentioned transfer of the protective layer transfer sheet is not particularly limited, and examples of this image-receiving sheets include the image-receiving sheets exemplified in the descriptions on the thermal transfer sheet (1) of the present invention.

By using the protective layer transfer sheet of the present invention, it is possible to make cards such as an ID card, an identification card, a driver's license and the like.

The above-mentioned cards may contain textual information in addition to image information such as photograph.

In the present invention, when textual information is formed on the above-mentioned cards, the formation of the textual information can be performed by a thermal fusion transfer method and the formation of the image such as photograph can be performed by a sublimation dye transfer method.

It is also possible to further provide prints such as embossing, a signature, an IC memory, a magnetic layer, a hologram, and other prints on the above cards, and it is also possible to provide embossing, a signature, a magnetic layer and the like after transferring a protection transfer layered body.

When the protective layer transfer sheet of the present invention is used to perform the image formation and the transfer of a protection transfer layered body, dye transfer and transfer of a protection transfer layered body may be separately performed by appropriately setting transfer conditions using different thermal transfer printers, or may be performed by adjusting each printing energy for each transfer using the same printer.

The protective layer transfer sheet of the present invention is not limited to the thermal transfer printer, and it can also be transferred by a hot plate, a hot stamper, a heat roller, a line heater, a smoothing iron, and the like.

Since the sheet of the present invention has the above-mentioned constitution, it has a good transferring property. In particular, the thermal transfer sheet of the present invention has good adhesion between the base material and the dye layer and can perform thermal transfer at high speed and does not cause abnormal transfer of the dye layer to the image-receiving sheet. Further, since the above-mentioned thermal transfer sheet can prevent the dye from transferring from the dye layer to the under coat layer in printing and can perform the dye diffusion to the receiving layer side of the image-receiving sheet effectively, transfer sensitivity in printing is high and a print density can be enhanced. Particularly, the thermal transfer sheet (2) of the present invention can be fabricated without highly stretching and can produce a thin layer printed substance at lower cost than conventional thermal diffusion type thermal transfer sheets since it is formed by using a base material having low strength of a base.

Since the protective layer transfer sheet of the present invention has the above-mentioned constitution, it has an excellent transferring property and an excellent antistatic property and hardly causes troubles of static electricity in transferring the dye to a body on which the dye is transferred. Therefore, the protective layer transfer sheet of the present invention can attain a printed substance having the excellent transparency, plasticizer resistance and antistatic property.

BEST MODE FOR CARRYING OUT THE INVENTION

Next, the present invention will be described in more detail by way of examples and comparative examples. In addition, "part(s)" or "%" refers to "part(s) by weight" or "% by weight" in Examples, unless otherwise specified.

Each data in examples and comparative examples were obtained by the following procedure.

1. Thickness of Base Material

A thickness of a base material was determined by calculation from values obtained by measuring a thickness of ten thicknesses of base materials with a micrometer (MFC-191 manufactured by Nikon Corporation).

2. Breaking Strength and Breaking Elongation

Breaking strength and breaking elongation were measured according to JIS C 2151.

EXAMPLE 1

A coating solution 1 for a under coat layer, which had the following composition, was applied onto a polyethylene terephthalate (PET) film having a thickness of 4.5 μm as a base material in such a way that a dried amount of application was 0.06 g/m$^2$ by gravure coating, and the applied coating solution 1 was dried to form an under coat layer.

A coating solution for a dye layer, having the following composition, was applied onto the formed under coat layer in such a way that a dried amount of application was 0.7 g/m$^2$ by gravure coating, and the applied coating solution was dried to form a dye layer to prepare a thermal transfer sheet of Example 1.

Further, a coating solution for a heat resistant slipping layer, having the following composition, had been applied onto a face on the other side of the above-mentioned base material in advance in such a way that a dried amount of application was 1.0 g/m$^2$ by gravure coating, and the applied coating solution had been dried to form a heat resistant slipping layer.

| <Coating solution 1 for a under coat layer> | |
|---|---|
| colloidal silica (SNOWTEX OXS, particle diameter of 4 to 6 nm, produced by Nissan Chemical Industries, Ltd.) | 50 parts |
| water | 25 parts |
| isopropyl alcohol | 25 parts |

| <Coating solution for a dye layer> | |
|---|---|
| C.I. solvent blue 63 (S-LEC BX-1 produced by SEKISUI CHEMICAL CO., LTD.) | 6.0 parts |
| polyvinyl butyral resin (S-LEC BX-1 produced by SEKISUI CHEMICAL CO., LTD.) | 3.0 parts |
| methyl ethyl ketone | 45.5 parts |
| toluene | 45.5 parts |

| <Coating solution for a heat resistant slipping layer> | |
|---|---|
| polyvinyl butyral resin (S-LEC BX-1 produced by SEKISUI CHEMICAL CO., LTD.) | 13.6 parts |
| polyisocyanate curing agent (Takenate D218 produced by Takeda Pharmaceutical Co., Ltd.) | 0.6 parts |
| phosphate ester (PLYSURF produced by DAI-ICHI KOGYO SEIYAKU CO., LTD.) | 0.8 parts |
| methyl ethyl ketone | 42.5 parts |
| toluene | 42.5 parts |

EXAMPLE 2

A thermal transfer sheet of Example 2 was prepared by following the same procedure as in Example 1 except for changing the composition of the under coat layer to the following composition in the thermal transfer sheet prepared in Example 1.

| <Coating solution 2 for a under coat layer> | |
|---|---|
| alumina sol (Alumina Sol 200, feather form, produced by Nissan Chemical Industries, Ltd.) | 50 parts |
| water | 25 parts |
| isopropyl alcohol | 25 parts |

EXAMPLE 3

A thermal transfer sheet of Example 3 was prepared by following the same procedure as in Example 1 except for changing the composition of the under coat layer to the following composition in the thermal transfer sheet prepared in Example 1.

| <Coating solution 3 for a under coat layer> | |
|---|---|
| alumina sol (Alumina Sol 520, boehmite plate crystal form, produced by Nissan Chemical Industries, Ltd.) | 25 parts |

-continued

| <Coating solution 3 for a under coat layer> | |
|---|---|
| water | 37.5 parts |
| isopropyl alcohol | 37.5 parts |

COMPARATIVE EXAMPLE 1

Using a base material of a PET film under the same conditions as in Example 1, a heat resistant slipping layer similar to that in Example 1 had been formed on a face on the other side of this base material in advance. The coating solution for a dye layer, used in Example 1, was applied directly onto a back face of the face of the base material on which the heat resistant slipping layer had been provided in such a way that a dried amount of application was 0.7 g/m$^2$ by gravure coating, and the applied coating solution was dried to form a dye layer to prepare a thermal transfer sheet of Comparative Example 1.

COMPARATIVE EXAMPLE 2

Using a base material of a PET film under the same conditions as in Example 1, a heat resistant slipping layer similar to that in Example 1 had been formed on a face on the other side of this base material in advance. The coating solution 1 for an adhesive layer, having the following composition, was applied onto a back face of the face of the base material on which the heat resistant slipping layer had been provided in such a way that a dried amount of application was 0.06 g/m$^2$ by gravure coating, and the applied coating solution was dried to form an adhesive layer. Furthermore, a dye layer was formed on the formed adhesive layer as with Example 1 to prepare a thermal transfer sheet of Comparative Example 2.

| <Composition solution 1 for an adhesive layer> | |
|---|---|
| polyvinylpyrrolidone resin (K-90 produced by ISP Japan Ltd.) | 10 parts |
| water | 100 parts |
| isopropyl alcohol | 100 parts |

COMPARATIVE EXAMPLE 3

Using a base material of a PET film under the same conditions as in Example 1, a heat resistant slipping layer similar to that in Example 1 had been formed on a face on the other side of this base material in advance. The coating solution 2 for an adhesive layer, having the following composition, was applied onto a back face of the face of the base material on which the heat resistant slipping layer had been provided in such a way that a dried amount of application was 0.06 g/m$^2$ by gravure coating, and the applied coating solution was dried to form an adhesive layer. Furthermore, a dye layer was formed on the formed adhesive layer as with Example 1 to prepare a thermal transfer sheet of Comparative Example 3.

| <Composition solution 2 for an adhesive layer> | |
|---|---|
| polyester resin (WR-961 produced by Nippon Synthetic Chemical Industry Co. Ltd.) | 3 parts |

-continued

| <Composition solution 2 for an adhesive layer> | |
|---|---|
| water | 50 parts |
| isopropyl alcohol | 50 parts |

TEST EXAMPLE 1

The following measurements were conducted on the thermal transfer sheets of Examples 1 to 3 and Comparative Examples 1 to 3.

<Reflection Density>

The thermal transfer sheets of Examples and Comparative Examples described above were used in combination with a printer-specific thermal transfer image-receiving sheet for a printer P-400 manufactured by OLYMPUS Corporation to perform printing in the following conditions, and reflection densities of the resulting printed substances were measured with a MacBeth RD-918 reflective color density meter.

(Printing Conditions)

thermal head; KGT-217-12MPL20 (manufactured by KYOCERA Corporation)

average resistance of heating element; 2994 (Ω)

print density in main scanning direction; 300 dpi print density in sub scanning direction; 300 dpi applied power; 0.10 (w/dot)

one line cycle; 5 (msec.)

print starting temperature; 40 (° C.)

applied pulse (tone control method); Using a test printer of multi-pulse mode which can adjust the number of divided pulses having a pulse length obtained by equally dividing the one line cycle into 256 from 0 to 255 in one line cycle, a duty ratio of each divided pulse was fixed at 70%, and the number of pulses per line cycle was separated into 15 stages between 0 and 255. Thereby, 15 stages of different energies can be provided.

On the printed substances in the above examples and comparative examples, a reflection density of the maximum density (255th tone) was measured.

<Adhesion Strength of Dye Layer>

Using the thermal transfer sheets prepared above, a cellotape (trademark) was stuck on the dye layer by rubbing a tape against the dye layer two times with a thumb, and shortly thereafter, the tape was peeled off. The adhesion strength was evaluated based on the presence or absence of the adhesion of the dye layer to the tape.

Evaluations were conducted according to the following criteria.

○: There is no adhesion of the dye layer.

Δ: There is a little adhesion of the dye layer.

x: There is adhesion of the dye layer all over the cellotape.

<Evaluation of Releasing Property>

In the same printing conditions as in the measurements of the reflection density described above, printing was performed in a printing pattern in which the whole surface of the printed substance is in a solid state (tone value 255/255: maximum density), and it was visually investigated whether the thermal adhesion of a dye layer of a thermal transfer sheet to a thermal transfer image-receiving sheet occurs in printing or not, or whether the so-called abnormal transfer, in which the whole dye layer is transferred to the thermal transfer image-receiving sheet, arises or not.

Evaluations were conducted according to the following criteria.

○: The thermal adhesion of a dye layer to a thermal transfer image-receiving sheet does not occur and the abnormal transfer does not arise.

x: The thermal adhesion of a dye layer to a thermal transfer image-receiving sheet occurs or the abnormal transfer arises.

The measurements of the reflection density described above and the results of evaluations of the adhesion strength of a dye layer and the releasing property are shown in the following Table 1.

TABLE 1

| | Under coat layer | Reflection density | Adhesive strength of dye layer | Evaluation of releasing property |
|---|---|---|---|---|
| Example 1 | colloidal silica | 2.39 | Δ | ○ |
| Example 2 | alumina sol | 2.56 | ○ | ○ |
| Example 3 | alumina sol | 2.3 | ○ | ○ |
| Comparative Example 1 | — | 2.16 | X | X |
| Comparative Example 2 | polyvinylpyrrolidone resin | 2.15 | ○ | ○ |
| Comparative Example 3 | polyester resin | 1.93 | ○ | ○ |

From the above-mentioned results, all of the thermal transfer sheets of Examples 1 to 3, each of which was provided with under coat layer comprising colloidal inorganic pigment ultrafine particles between the base material and the dye layer, had the above reflection densities of 2.30 or more which were high concentrations. Further, all of the thermal transfer sheets of Examples 1 to 3 achieved good results on a releasing property, and the adhesion of the dye layer to the base material was of no matter.

The thermal transfer sheets of Comparative Examples 1 to 3 had the above reflection densities of less than 2.2 and were not satisfactory as printed substances having a high print density since each thermal transfer sheet was not provided with the under coat layer comprising colloidal inorganic pigment ultrafine particles between the base material and the dye layer. Further, in Comparative Example 1, there were practical problems on the adhesion of a dye layer to a base material and the releasing property against a thermal transfer image-receiving sheet.

EXAMPLE 4

A thermal transfer sheet of Example 4 was prepared by following the same procedure as in Example 1 except for using a polyethylene terephthalate (PET) film (thickness 4.0 μm, strength of a base 3.5) as a base material.

EXAMPLE 5

A thermal transfer sheet of Example 5 was prepared by following the same procedure as in Example 1 except for using a PET film (thickness 4.5 μm, strength of a base 3.5) as a base material.

EXAMPLE 6

A thermal transfer sheet of Example 6 was prepared by following the same procedure as in Example 2 except for using a PET film (thickness 4.5 μm, strength of a base 3.7) as a base material.

EXAMPLE 7

A thermal transfer sheet of Example 7 was prepared by following the same procedure as in Example 3 except for using a PET film (thickness 4.5 μm, strength of a base 3.5) as a base material.

COMPARATIVE EXAMPLE 4

A thermal transfer sheet was prepared by following the same procedure as in Comparative Example 1 except for using a PET film (thickness 4.5 μm, strength of a base 3.5) as a base material.

COMPARATIVE EXAMPLE 5

A thermal transfer sheet was prepared by following the same procedure as in Comparative Example 1 except for using a PET film (thickness 4.5 μm, strength of a base 4.0) as a base material.

TEST EXAMPLE 2

The following tests were conducted on the thermal transfer sheets obtained in Examples 4 to 7 and Comparative Examples 4 to 5.

1. Best Print Density

Using a sublimation type thermal transfer printer (MEGA-PIXEL III manufactured by ALTECH CO., LTD.) and an image-receiving paper which is the above printer-specific, printing was performed in a cyan solid image pattern and the resulting printed substance was measured with a reflective color density meter MacBeth RD-918 (C filter) to determine the best print density.

In addition, with respect to a tone value of print data, it is assumed that a 255 tones corresponds to a state of 100% solid, and a tone value in printing a pattern divided by 255 represents a ratio of applied energy of the pattern to the maximum applied energy (for example, when a tone value in printing is 210 tones, since 210/255=0.823, the pattern is in a solid state of 83%).

The above-mentioned tone value in printing was adjusted by changing arbitrarily with a Photo Shop.

2. Tone Value without Occurrence of Wrinkle

The tone value was increased in increments of 5 to print the solid pattern by the printing method described in the above paragraph 1, and the energy lower than energy at which a wrinkle occurs by one rank is taken as a tone value without the occurrence of wrinkle.

The results of evaluations are shown in Table 2.

TABLE 2

| | Base material used | | | Print data | |
|---|---|---|---|---|---|
| | Thickness (μm) | Strength of base | Under coat layer (Primer layer) | Best print density (OD value) | Tone value without occurrence of wrinkle |
| Example 4 | 4.0 | 3.5 | under coat layer 1 | 2.20 | 200 |
| Example 5 | 4.5 | 3.5 | under coat layer 1 | 2.20 | 200 |
| Example 6 | 4.5 | 3.7 | under coat layer 2 | 2.25 | 200 |
| Example 7 | 4.5 | 3.5 | under coat layer 3 | 2.20 | 200 |
| Comparative Example 4 | 4.5 | 3.5 | none | 1.80 | 200 |
| Comparative Example 5 | 4.5 | 4.0 | none | 2.20 | 255 |

Although printed substances obtained from Examples 4 to 7 had low strength of a base of 3.5 or 3.7, they could attain the best print density equal to that in Comparative Example 5 where the strength of a base was 4.0. On the other hand, it was found that the best print density of the printed substance obtained from the thermal transfer sheet, not having the under coat layer, in the present invention in Comparative Example 4 was inferior to that of printed substances obtained from Examples 4 to 7.

EXAMPLE 8

A coating solution for a heat resistant slipping layer, having the following composition, was applied onto a base sheet (polyethylene terephthalate (PET) film, produced by Toray Industries, Inc., thickness 4.5 μm) in such a way that a dried amount of application was 0.5 g/m$^2$ by gravure coating, and the applied coating solution was dried to form a heat resistant slipping layer.

| <Coating solution for a heat resistant slipping layer> | |
|---|---|
| polyamideimide resin (HR-15ET produced by TOYOBO CO., LTD.) | 50.0 parts |
| polyamideimide silicone resin (HR-14ET produced by TOYOBO CO., LTD.) | 50.0 parts |
| zinc stearyl phosphate (LBT-1830 purified produced by Sakai Chemical Industry Co., Ltd.) | 10.0 parts |
| zinc stearate (GF-200 produced by NOF CORPORATION) | 10.0 parts |
| polyester resin (VYLON 220 produced by TOYOBO CO., LTD.) | 3.0 parts |
| inorganic filler (talc, average particle diameter 4.2 μm) | 10.0 parts |

Next, a coating solution A for a protective layer, having the following composition, was applied onto a face on the back-side of the side of the base sheet on which the heat resistant slipping layer is provided in such a way that a dried amount of application was 1.0 g/m$^2$ by gravure coating, and the applied coating solution A was dried to form a protective layer.

| <Coating solution A for a protective layer> | |
|---|---|
| acrylic resin (DIANAL BR-83 produced by Mitsubishi Rayon Co., Ltd.) | 50 parts |
| methyl ethyl ketone | 25 parts |
| toluene | 25 parts |

Next, a coating solution A for a conductive layer, having the following composition, was applied onto the above-mentioned protective layer in such a way that a dried amount of application was 0.2 g/m$^2$ by gravure coating, and the applied coating solution A was dried to form a conductive layer.

| <Coating solution A for a conductive layer> | |
|---|---|
| alumina sol (Alumina Sol 100, stabilized by hydrochloric acid, produced by Nissan Chemical Industries, Ltd.) | 50 parts |
| water | 25 parts |
| isopropyl alcohol | 25 parts |

Further, a coating solution for an adhesive layer, having the following composition, was applied onto the above-mentioned conductive layer in such a way that a dried amount of application was 1.5 g/m$^2$ by gravure coating, and the applied coating solution was dried to obtain a protective layer transfer sheet of Example 8.

| <Coating solution for an adhesive layer> | |
|---|---|
| polyester resin (VYLON 700 produced by TOYOBO CO., LTD.) | 69.6 parts |
| acrylic copolymer to which a reactive UV absorber is bonded by a reaction (PUVA-50M-40TM produced by OTSUKA Chemical Co., Ltd.) | 17.4 parts |
| silica (Sylysia 310 produced by Fuji Silysia Chemical Ltd.) | 25 parts |

EXAMPLE 9

A protective layer transfer sheet of Example 9 was obtained by following the same procedure as in Example 8 except for changing the coating solution A for a conductive layer used in Example 8 to a coating solution B for a conductive layer having the following composition.

| <Coating solution B for a conductive layer> | |
|---|---|
| alumina sol (Alumina Sol 200, stabilized by acetic acid, produced by Nissan Chemical Industries, Ltd.) | 50.0 parts |
| water | 25.0 parts |
| isopropyl alcohol | 25.0 parts |

EXAMPLE 10

A protective layer transfer sheet of Example 10 was obtained by following the same procedure as in Example 8 except for applying a coating solution for a release layer, having the following composition, onto a surface between the base sheet and the protective layer in such a way that a dried amount of application was 1.0 g/m$^2$ by gravure coating and drying the applied coating solution to provide a release layer in the protective layer transfer sheet prepared in Example 8.

| <Coating solution for a release layer> | |
|---|---|
| silicone modified acrylic resin (CELTOP 226 produced by DAICEL CHEMICAL INDUSTRIES, LTD.) | 45.7 parts |
| aluminum catalyst (CELTOP CAT-A produced by DAICEL CHEMICAL INDUSTRIES, LTD.) | 8.5 parts |
| methyl ethyl ketone | 22.9 parts |
| toluene | 22.9 parts |

COMPARATIVE EXAMPLE 6

A protective layer transfer sheet of Comparative Example 6 was obtained by following the same procedure as in Example 8 except for not providing a conductive layer in the protective layer transfer sheet prepared in Example 8.

COMPARATIVE EXAMPLE 7

A protective layer transfer sheet of Comparative Example 7 was obtained by following the same procedure as in Example 8 except for changing the coating solution A for a protective layer used in Example 8 to a coating solution B for a protective layer having the following composition and except for further not providing a conductive layer.

| <Coating solution B for a protective layer> | |
|---|---|
| acrylic resin (DIANAL BR-83 produced by Mitsubishi Rayon Co., Ltd.) | 50 parts |
| needle conductive inorganic material (FSS-10M produced by Ishihara Techno Corporation) | 25 parts |
| methyl ethyl ketone | 37.5 parts |
| toluene | 37.5 parts |

(FSS-10M is a conductive substance consisting of tin oxide (antimony-doped), solid content 30%, aspect ratio 20 to 30.)

COMPARATIVE EXAMPLE 8

A protective layer transfer sheet of Comparative Example 8 was obtained by following the same procedure as in Example 8 except for changing the coating solution A for a protective layer used in Example 8 to a coating solution C for a protective layer having the following composition and except for further not providing a conductive layer.

| <Coating solution C for a protective layer> | |
|---|---|
| acrylic resin (DIANAL BR-83 produced by Mitsubishi Rayon Co., Ltd.) | 50 parts |
| quaternary ammonium salt base surfactant (STATICIDE produced by ACL STATICIDE Inc.) | 25 parts |
| methyl ethyl ketone | 37.5 parts |
| toluene | 37.5 parts |

The following tests were conducted on the protective layer transfer sheets of Examples 8 to 10 and Comparative Examples 6 to 8.

1. Transparency

Using a sublimation type thermal transfer sheet with three colors of Y (yellow), M (magenta), and C (cyan), a black solid image was printed on a printer-specific image-receiving paper with a printer (CP-2000 manufactured by Mitsubishi Electric Corporation). On this obtained printed substance, a protection transfer layered body was transferred with the above printer using the protective layer transfer sheets of Examples 8 to 10 or Comparative Examples 6 to 8 to obtain printed substances. The difference in print densities between the printed substances obtained from the protective layer transfer sheets of Examples 8 to 10 and Comparative Examples 7 to 8 and the printed substance obtained similarly from the protective layer transfer sheet of Comparative Example 6 was measured and evaluated according to the following criteria. The above-mentioned print density of a printed substance was measured around 2.0 of O.D. value by a color density meter (MacBeth RD-918 reflective color density meter manufactured by GretagMacbeth AG.).

(Evaluation Criteria)

○: The print density is lower than that of the printed substance obtained from Comparative Example 6 but the difference in print densities from the printed substance obtained from Comparative Example 6 is less than 5%.

Δ: The print density is lower than that of the printed substance obtained from Comparative Example 6 and the difference in print densities from the printed substance obtained from Comparative Example 6 is 5% or more and less than 10%.

x: The print density is lower than that of the printed substance obtained from Comparative Example 6 and the difference in print densities from the printed substance obtained from Comparative Example 6 is 10% or more.

2. Transferring Property

Printed substances obtained by transferring a protection transfer layered body under the same conditions as in the above paragraph 1, using the same printer and printer-specific image-receiving paper as in the above paragraph 1, were visually evaluated according to the following criteria.

(Evaluation Criteria)

○: The protection transfer layered body is completely transferred.

x: A part of the protection transfer layered body is faint.

3. Plasticizer Resistance

With respect to the printed substances obtained by transferring a protection transfer layered body by the method described in the above paragraph 1, a soft polyvinyl chloride sheet containing a plasticizer (ARUTRON produced by Mitsubishi Chemical Corporation, #480, 400 μm in thickness) was placed on each of the above-mentioned printed substances to form a sample, and the sample was stored under the condition of 50° C. for 60 hours with a load of 40 grams per unit square centimeters being applied, and the damages (dye transfer) of the printed substances due to the plasticizer were visually evaluated according to the following criteria.

(Evaluation Criteria)

○: The dye transfer is not found.

Δ: The dye transfer to the soft polyvinyl chloride sheet is little.

x: The dye transfer to the soft polyvinyl chloride sheet is much.

4. Surface Resistivity

The surface resistivity of a protection transfer layered body in a protective layer transfer sheet before forming an image was measured with a high-resistivity meter (Hiresta IP MCP-HT 250 manufacture by DIA INSTRUMENTS CO., LTD.) according to JIS K6911. The measurement of the surface resistivity was conducted after applying a voltage of 100 V for 10 seconds under the circumstances of 23° C., relative humidity 60 percent. Further, the surface resistivity of a printed substance, an image of which the protection transfer layered body was transferred and formed on was measured by the same method.

The results of evaluations are shown in Table 3.

TABLE 3

| | Transparency | Transferring property | Plasticizer resistance | Surface resistivity of protection transfer laminate (Ω/□) | Surface resistivity of printed substance (Ω/□) |
|---|---|---|---|---|---|
| Example 8 | ○ | ○ | ○ | $3 \times 10^8$ | $3 \times 10^8$ |
| Example 9 | ○ | ○ | ○ | $5 \times 10^9$ | $5 \times 10^9$ |
| Example 10 | ○ | ○ | ○ | $3 \times 10^8$ | $3 \times 10^8$ |
| Comparative Example 6 | ○ | ○ | Δ | OVER RANGE | OVER RANGE |
| Comparative Example 7 | x | ○ | Δ | $6 \times 10^9$ | $6 \times 10^9$ |
| Comparative Example 8 | Δ | x | x | $7 \times 10^{10}$ | $7 \times 10^{10}$ |

Each of the protective layer transfer sheets of Examples 8 to 10 had a good transferring property and a low surface resistivity, and printed substances obtained from these protective layer transfer sheets had excellent transparency and excellent plasticizer resistance and a low surface resistivity.

On the other hand, it was verified that the protective layer transfer sheets of Comparative Examples 6 to 8 had a high surface resistivity and printed substances obtained from these protective layer transfer sheets had poor plasticizer resistance. Particularly, the printed substances obtained from Comparative Examples 7 and 8 had poor transparency, and the protective layer transfer sheet of Comparative Example 8 also had a poor transferring property.

INDUSTRIAL APPLICABILITY

Since the sheet of the present invention has the above-mentioned constitution, it has a good transferring property. In particular, the thermal transfer sheet of the present invention has good adhesion between the base material and the dye layer and can perform thermal transfer at high speed and does not cause abnormal transfer of the dye layer to the image-receiving sheet. Further, since the above-mentioned thermal transfer sheet can prevent the dye from transferring from the dye layer to the under coat layer in printing and can perform the dye diffusion to the receiving layer side of the image-receiving sheet effectively, transfer sensitivity in printing is high and a print density can be enhanced. Particularly, the thermal transfer sheet (2) of the present invention can be fabricated without highly stretching and can produce a thin layer substance at lower cost than conventional thermal diffusion type thermal transfer sheets since it is formed by using a base material having low strength of a base.

Since the protective layer transfer sheet of the present invention has the above-mentioned constitution, it has an excellent transferring property and an excellent antistatic property and hardly causes troubles of static electricity in transferring the dye to a body on which the dye is transferred. Therefore, the protective layer transfer sheet of the present invention can attain printed substances having the excellent transparency, plasticizer resistance and antistatic property.

DESCRIPTION OF SYMBOLS

Figure 1:
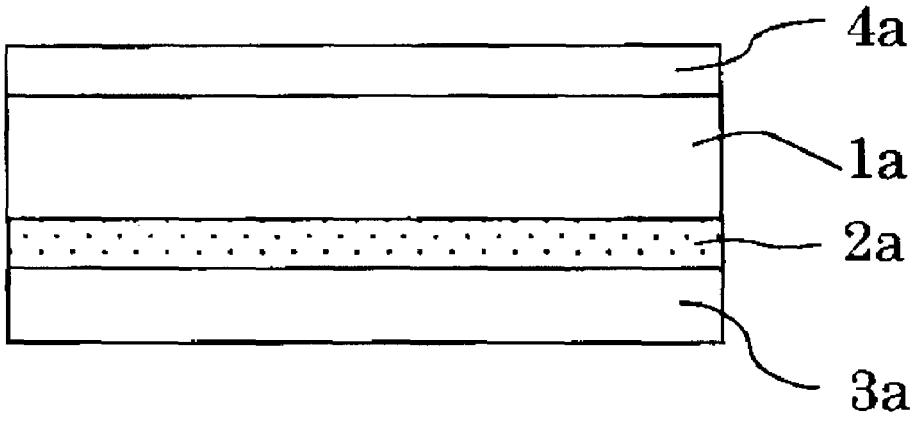
FIG. 1 is a schematic sectional view showing the best embodiment which is a thermal transfer sheet (1) of the present invention.
Figure 2:
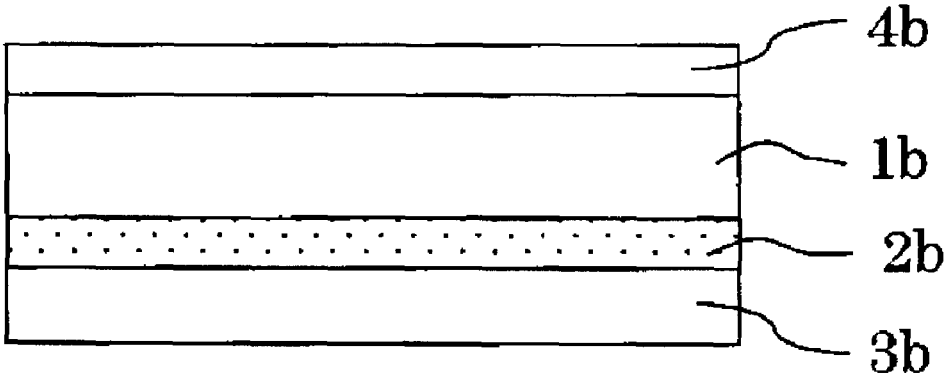
FIG. 2 is a sectional view showing an example of a thermal transfer sheet (2) of the present invention.
Figure 3:
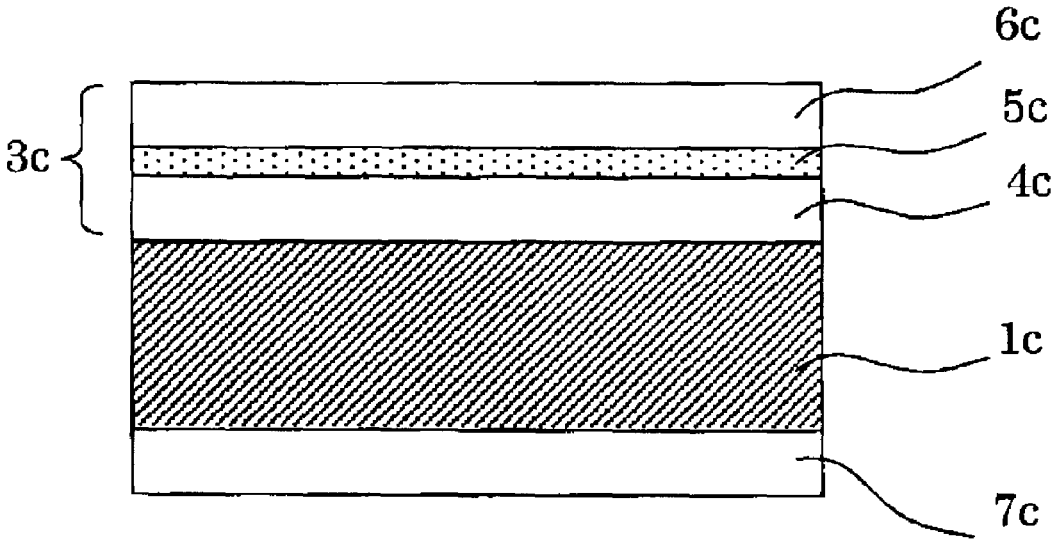
FIG. 3 is a view showing an example of a protective layer transfer sheet of the present invention.
Figure 4:
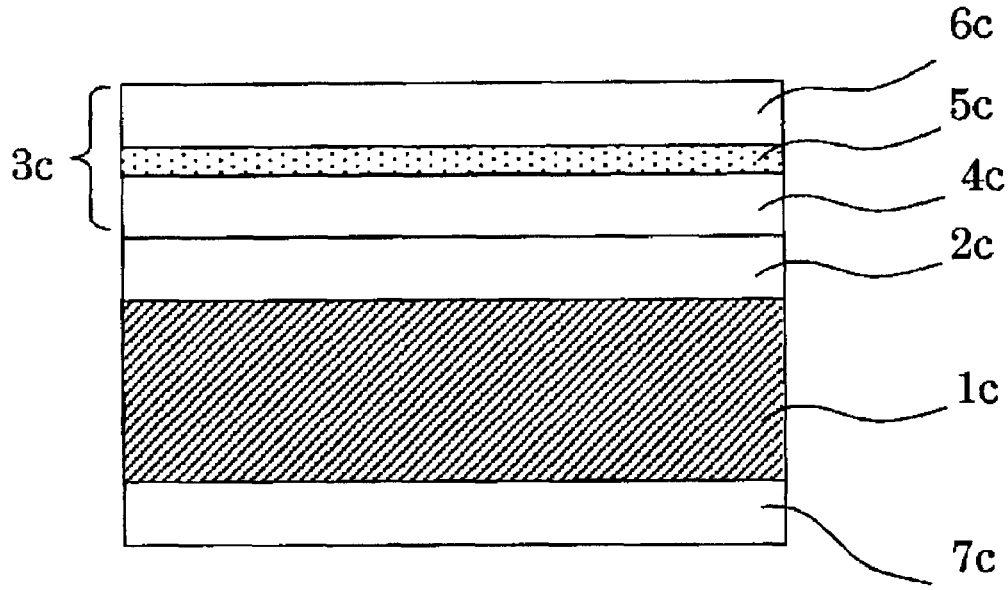
FIG. 4 is a view showing an example of a protective layer transfer sheet, including a release layer, of the present invention.
Figure 5:
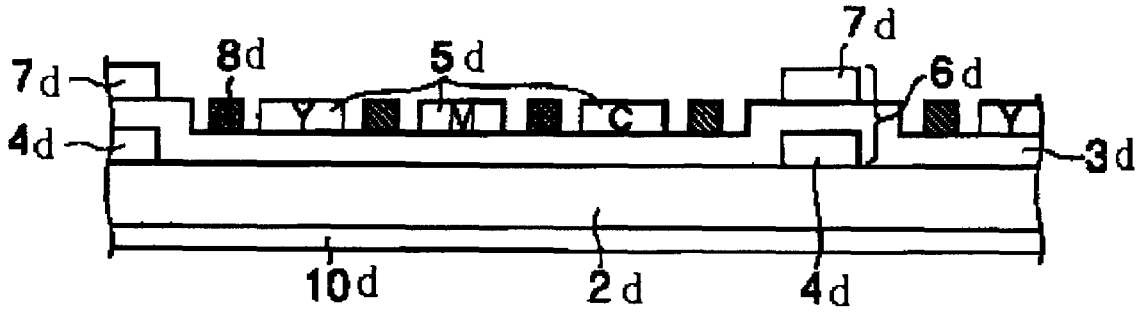
FIG. 5 is a sectional view showing an example of a protective layer transfer sheet, provided with a colored thermal transfer sheet, of the present invention.

| DESCRIPTION OF SYMBOLS | |
|---|---|
| 1a | base material |
| 2a | under coat layer comprising colloidal inorganic pigment ultrafine particles |
| 3a | dye layer |
| 4a | heat resistant slipping layer |
| 1b | base material |
| 2b | primer layer |
| 3b | dye layer |
| 4b | heat resistant slipping layer |
| 1c | base sheet |
| 2c | release layer |
| 3c | protection transfer layered body |
| 4c | protective layer |
| 5c | conductive layer |
| 6c | adhesive layer |
| 7c | heat resistant slipping layer |
| 2d | base material |
| 3d | conductive layer |
| 4d | protective layer |
| 5d | colored thermal transfer sheet |
| 6d | protection transfer layered body |
| 7d | adhesive layer |
| 8d | detection mark |
| 10d | heat resistant slipping layer |

The invention claimed is:

1. A sheet including a base material, wherein said sheet is (I) a thermal transfer sheet formed by forming a base material, an under coat layer and a dye layer in this order, or (II) a protective layer transfer sheet including peelably a protection transfer layered body including a conductive layer in at least a part of the surface of a base material and said under coat layer and said conductive layer are formed by using colloidal inorganic pigment ultrafine particles, and wherein said under coat layer and said conductive layer do not contain a binder resin.

2. A thermal transfer sheet, which comprises an under coat layer including colloidal inorganic pigment ultrafine particles and a dye layer formed in succession on a face on one side of a base material, and wherein said under coat layer does not contain a binder resin.

3. The thermal transfer sheet according to claim 2, wherein a heat resistant slipping layer is further provided onto a face of the backside of the side of the base material on which the dye layer is provided.

4. The thermal transfer sheet according to claim 2, wherein the colloidal inorganic pigment ultrafine particle is colloidal silica or alumina sol.

5. The thermal transfer sheet according to claim 2, wherein the colloidal inorganic pigment ultrafine particle is alumina sol.

6. A thermal transfer sheet formed by providing a base material, a primer layer and a dye layer in this order, wherein said primer layer is formed by using colloidal inorganic pigment ultrafine particles, and the strength of said base material, which is represented by a ratio [$S_1/S_2$] of breaking strength [$S_1$ (MPa)] to breaking elongation [$S_2$ (MPa)] along a longitudinal direction, is 3.5 or larger and smaller than 4.0, and wherein said primer layer does not contain a binder resin.

7. The thermal transfer sheet according to claim 6, wherein said thermal transfer sheet is a thermal diffusion type.

8. A protective layer transfer sheet, wherein said protective layer transfer sheet includes peelably a protection transfer layered body in at least a part of the surface of a base sheet, said protection transfer layered body includes a conductive layer formed by using inorganic pigment ultrafine particles and said conductive layer does not contain a binder resin.

9. The protective layer transfer sheet according to claim 8, wherein the inorganic pigment ultrafine particle is alumina sol.

10. The protective layer transfer sheet according to claim 9, wherein the protection transfer layered body is provided on an untransferable release layer formed on a base sheet.

11. The protective layer transfer sheet according to claim 8, wherein the protection transfer layered body is formed by forming a protective layer, a conductive layer and an adhesive layer in this order from a base sheet side.

12. The protective layer transfer sheet according to claim 8, including the protection transfer layered body located at a part of the surface of a base sheet and having a colored thermal transfer layer, a sublimation dye layer having one or more colors or a thermofusible color material layer having one or more colors, which is arranged sequentially together with said protection transfer layered body on said surface of the base sheet.

13. The protective layer transfer sheet according to claim 8, said protective layer transfer sheet being a thermal transfer sheet, including the protection transfer layered body located at a part of the surface of a base sheet and having the colored thermal transfer layer, a sublimation dye layer having one or more colors or a thermofusible color material layer having one or more colors, arranged sequentially together with said protection transfer layered body on said surface of the base sheet, wherein said protection transfer layered body includes a conductive layer and further a protective layer, and said protection transfer layered body is formed by providing said conductive layer on the whole surface on the side of said protective layer of the layered body formed by providing said protective layer at a part of the surface on one side of said base sheet and then providing said colored thermal transfer layer in a region on the conductive layer, below which said protective layer is not positioned.

14. A printed substance, wherein a protection transfer layered body is transferred and formed so as to cover at least a part of an image surface using the protective layer transfer sheet according to claim 8.

15. The thermal transfer sheet according to claim 3, wherein the colloidal inorganic pigment ultrafine particle is colloidal silica or alumina sol.

16. The thermal transfer sheet according to claim 3, wherein the colloidal inorganic pigment ultrafine particle is alumina sol.

17. The protective layer transfer sheet according to claim 8, wherein the protection transfer layered body is provided on an untransferable release layer formed on a base sheet.

* * * * *